US007261269B2

(12) United States Patent
Cote

(10) Patent No.: US 7,261,269 B2
(45) Date of Patent: Aug. 28, 2007

(54) SUPPORT FOR HANGING OBJECTS DISPLAYED ON A WALL

(76) Inventor: Renald Cote, 30, Jeanne D'Arc, Repentigny, Quebec (CA) J6A 6V4

( * ) Notice: Subject to any disclaimer, the term of this patent is extended or adjusted under 35 U.S.C. 154(b) by 46 days.

(21) Appl. No.: 11/150,560

(22) Filed: Jun. 10, 2005

(65) Prior Publication Data

US 2006/0278792 A1 Dec. 14, 2006

(51) Int. Cl.
*A47G 1/10* (2006.01)

(52) U.S. Cl. ..... 248/317; 40/617; 40/658

(58) Field of Classification Search ..... 248/317, 248/316.7, 316.3, 220.22, 452; 211/45, 89.01; 40/617, 606.18, 611.01, 658, 666, 611.2
See application file for complete search history.

(56) References Cited

U.S. PATENT DOCUMENTS 773,392 A 10/1904 Holsapple
1,165,108 A 12/1915 Memmler
3,346,909 A * 10/1967 Blackburn ..... 16/94 D
3,350,045 A 10/1967 Mayers
3,606,507 A 9/1971 Williams, Jr.
3,671,004 A 6/1972 Cram
3,914,892 A 10/1975 Mohr
4,105,127 A 8/1978 Höll
4,564,165 A * 1/1986 Grant et al. ..... 248/343
4,899,974 A * 2/1990 Wear et al. ..... 248/467
5,555,606 A 9/1996 Chu
5,987,795 A * 11/1999 Wilson ..... 40/658
6,257,422 B1 7/2001 Rios
6,453,518 B1 9/2002 Adams et al.
6,802,145 B2 10/2004 Sparkowski

* cited by examiner

*Primary Examiner*—Ramon O Ramirez

(57) ABSTRACT

A support for hanging objects displayed on a wall consists of a <<U>> shaped element integrated within a holding element. The <<U>> provides the added resiliency while the holding element provides the holding surface to frictionally hold the material to be held. Additionally, a hanging tab attached to the holding element to allow for hooking on a frame hook or, in this context, mechanical equivalents such as a screw, a tack, or a nail.

4 Claims, 3 Drawing Sheets

SUPPORT FOR HANGING OBJECTS DISPLAYED ON A WALL

BACKGROUND OF THE INVENTION

1. Field of the Invention

Figures 1A, 1B:
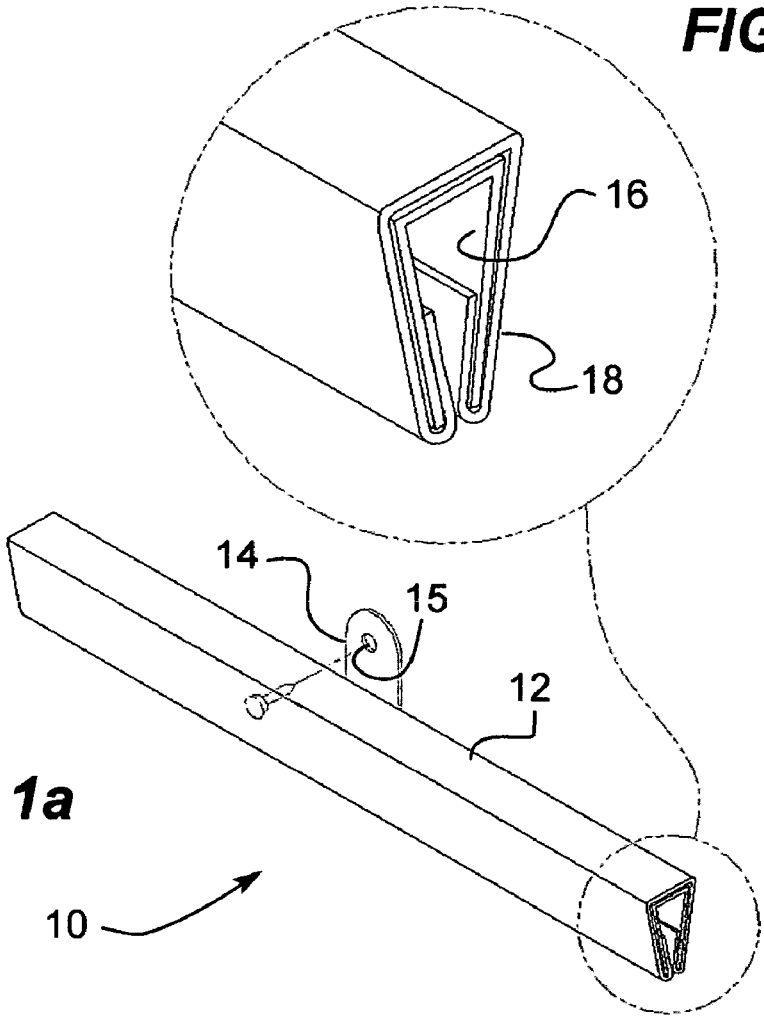

The invention relates generally to hangers and supports but more particularly to a support for hanging objects on a wall.

2. Background of the Invention

There are several support devices involving a horizontal bar clipping objects such as wall calendars, posters, etc. . . Seen laterally, they can have the shape of an inverted <<U>> and some have the shape of a <<W>>.

U.S. Pat. No. 773,392 shows a <<U>> shaped clip to hold papers within a cover.

U.S. Pat. No. 1,165,108 shows a semi circular clip to hold sheets.

U.S. Pat. No. 3,350,045 shows a <<U>> shaped clip to hold sheets.

U.S. Pat. No. 3,606,507 shows a <<U> shaped clip to hold sheets.

U.S. Pat. No. 3,671,004 shows a holding clip to hold sheets.

U.S. Pat. No. 3,914,892 shows top and bottom <<U>> clips.

U.S. Pat. No. 4,105,127 shows an an outer hollow <<U>> shaped rod and cover.

U.S. Pat. No. 4,899,974 shows a self-gripping clip poster hanger device consisting of an elongated body portion having a track formed in its upper end portion.

U.S. Pat. No. 5,555,606 shows a channel-sectioned component having a base and opposed upper and lower arms between which paper is held.

U.S. Pat. No. 6,257,422 shows a first portion and a backing member form a cavity. A first hinge interconnects the first portion to the backing member.

U.S. Pat. No. 6,453,516 shows a clip which has a base that is inserted into a groove within a cap sleeve, a clip body is located outside of the cap sleeve and has a surface substantially orthogonal to a radial direction, and a coupling portion which extends in the radial direction, for coupling the base to the clip body.

U.S. Pat. No. 6,802,145 shows a panel having score lines adjacent each opposed end to define opposed flaps. The first and second channels each have a flange extending from one wall to adjacent opposed wall to define the elongated opening into the channel.

The drawback over most of the prior art is that over time, a certain fatigue makes the support less rigid and less capable of suitably clipping what it is supposed to be holding.

SUMMARY OF THE INVENTION

It is a main advantage of this invention to provide for a resiliently deforming support which maintains a strong grip over time and over various width of material to be gripped.

In order to do so, the invention comprises a <<U>> shaped element integrated within a holding element. The <<U>> provides the added resiliency while the holding element provides the holding surface to frictionally hold the material to be held. Additionally, a hanging tab attached to the holding element to allow for hooking on a frame hook or, in this context, mechnanical equivalents such as a screw, a tack, or a nail.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE PREFERRED EMBODIMENT

FIG. 1*a* Perspective view of the invention.

FIG. 1*b* Perspective view detail of FIG. 1*a*.

Figure 2:
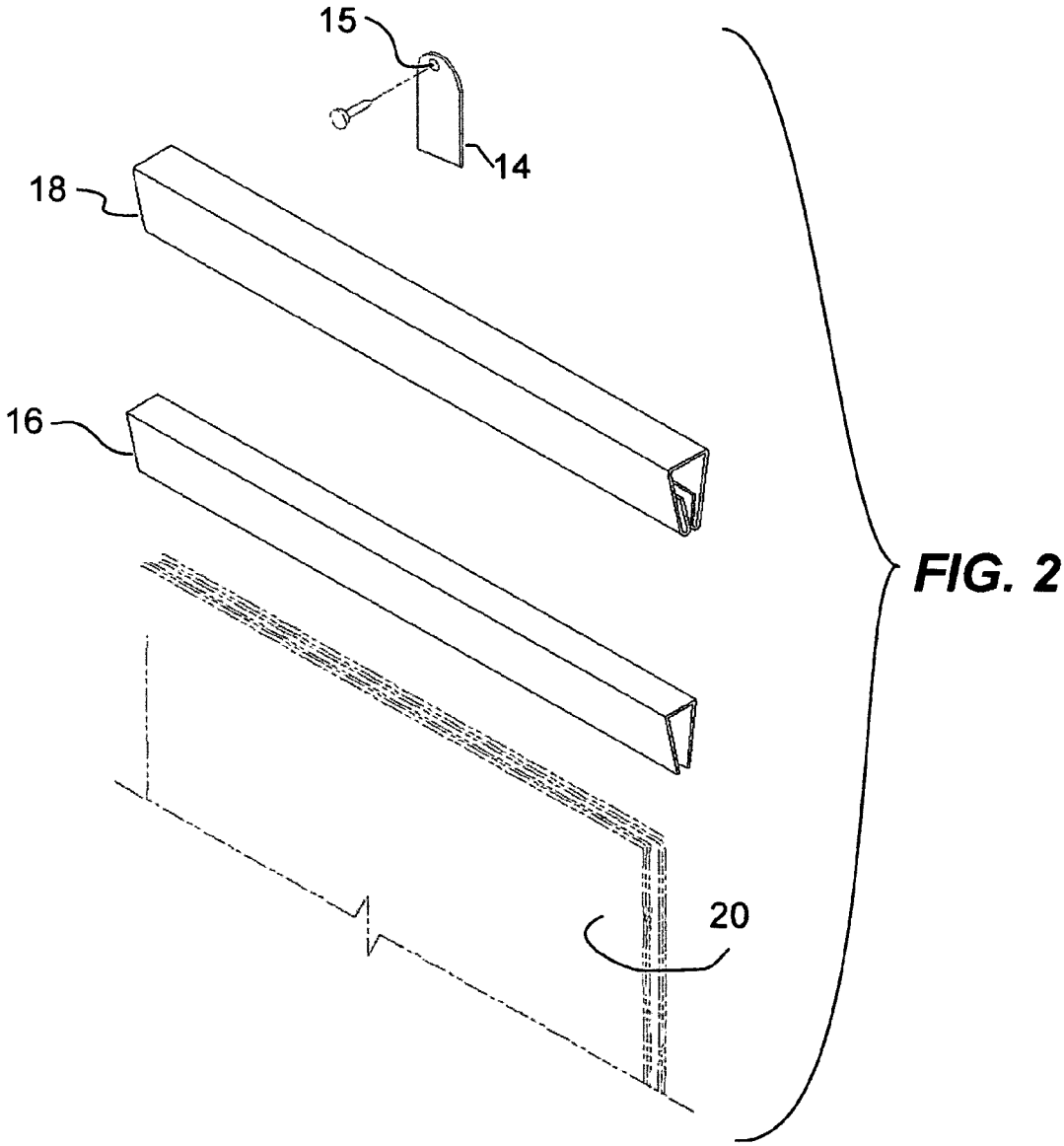

FIG. 2 Perspective exploded view of the invention.

Figure 3:
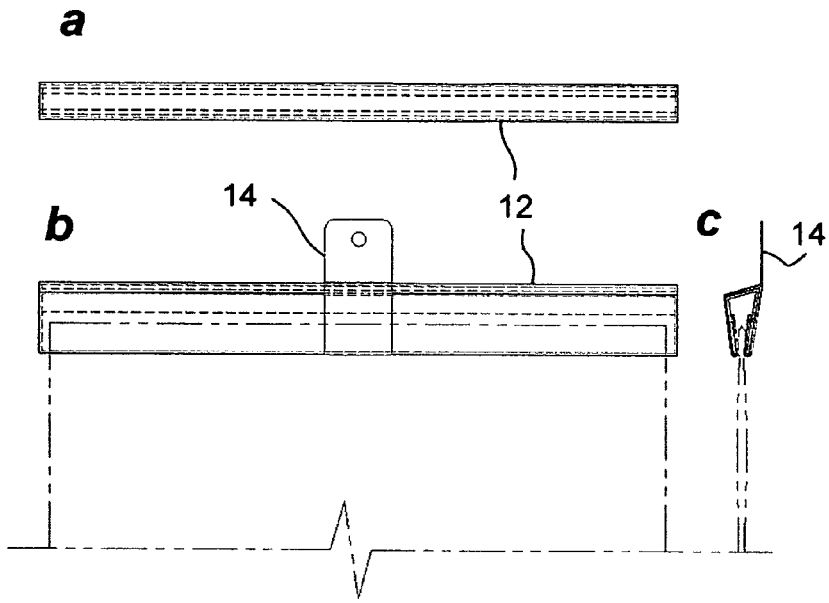

FIGS. 3*abc* Top front and side views respectively of the invention.

Figure 4:
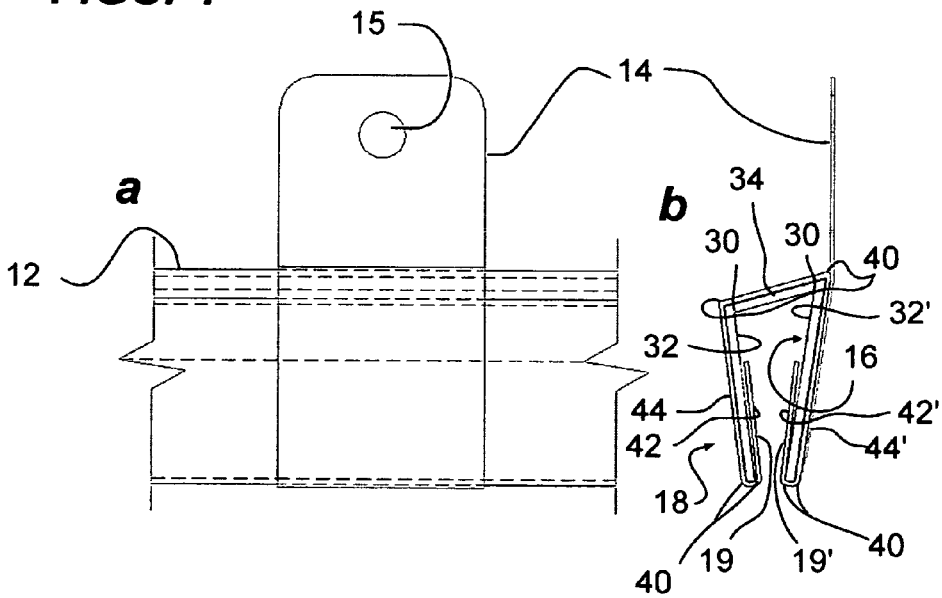

FIGS. 4*ab* Front and side detail of the hanging tab.

DETAILED DESCRIPTION OF THE PREFERRED EMBODIMENT

A support for hanging objects (10) is comprised of a support bar (12) The support bar has a hanging tab (14) allowing for hooking on a frame hook (not shown), or such mechnanical equivalents as described hereinabove, by passing through a hole (15). The hanging tab (14) is attached to the support bar by any one of a variety of known attachment means with the preferred being by way of an adhesive. The support bar (12) is subdivided into two distinct parts which are usually found one inside the other that is a <<U>> shaped element (16) is frictionally slid and fitted within a holding element (18). The <<U>> shaped element (16) provides added resiliency while the holding element (18) provides holding surfaces (19, 19') to frictionally hold an object (20) to be held within its grasp. The holding element is defined by a horizontal member, and two members extending in a generally vertical direction from the horizontal member, said two vertical extending members being folded at their respective free ends inwardly toward the horizontal member.

The <<U>> shaped element (16) has two folds (30), two flaps (32, 32') and a joining segment (34) creating the given shape that is biased so that both flaps (32, 32') ends that are opposite the joining segment (34) are biased or drawn towards each other.

The holdin element (18) has 6 folds (40), 2 long flaps (42, 42'), 2 short flaps (44, 44') and one long flap joining segment (46).

Besides the support bar (12) which is usually installed at the top, a similar bottom bar (12') can also be set at the bottom of the object (20) to add weight so as to keep the object down. This is important in the case of a calendar where several pages of the calendar may need to be held tightly together. The bottom bar (12') would not need to have a hanging tab (14).

To use the support for hanging objects (10), selected calendar pages are longitudinally slid starting from one extremity of the support bar (12), depending upon the width of the calendar, the support bar (12) can be trimmed so as to match the width of the calendar. The support bar (12) is then hung by way of its hanging tab (14). Optionally, a bottom bar (12') can be fitted in a similar fashion to that of the support bar (12).

Although the title of the invention and the description favors the word calendar, this is strictly for convenience and any suitably configured object can be hung using this support for hanging objects (10).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A support for hanging objects, comprising at least one support bar;

a hanging tab attached to said support bar;

said support bar being formed by a U-shaped element, and a holding element, said holding member comprising a horizontal member, and two members extending in a generally vertical direction from said horizontal member and folded at their respective free ends toward said horizontal member;

said U-shaped element being fitted and frictional secured within said holding element;

wherein said U-shaped element provides added resiliency, and the holding element provides holding surfaces to frictionally hold and object within its grasp.

2. A support for hanging objects as in claim 1 used according to the following steps;

the steps of inserting an object by longitudinally sliding said object by starting from one extremity of said support bar;

followed by the step of hanging said support bar by way of said hanging tab.

3. A support for hanging objects as in claim 1 wherein:

said <<U>> shaped element having two folds, two flaps and a joining segment creating a shape that is biased so that both said flaps' ends that are opposite said joining segment are biased towards each other;

said <<W>> shaped element having 6 folds, 2 long flaps, 2 short flaps, and one long flap joining segment.

4. A support for hanging objects as in claim 1 wherein:

said <<U>> shaped element being of a material that can be resiliently deformed.

* * * * *